United States Patent [19]

Mohr

[11] Patent Number: 4,850,257

[45] Date of Patent: Jul. 25, 1989

[54] APPARATUS FOR CUTTING STACKS OF SHEETS

[76] Inventor: Wolfgang Mohr, Hundshager Weg 42, D-6238 Hofheim, Fed. Rep. of Germany

[21] Appl. No.: 38,880

[22] Filed: Apr. 15, 1987

[30] Foreign Application Priority Data

Apr. 19, 1986 [DE] Fed. Rep. of Germany ..... 3613316

[51] Int. Cl.[4] ..... B26D 7/01

[52] U.S. Cl. ..... 83/93; 83/129; 83/404.2; 83/420; 83/446; 83/449; 83/467 R; 414/788

[58] Field of Search ..... 83/129, 93, 446, 449, 83/404, 404.1, 404.2, 401, 420, 467, 42; 414/222, 331, 28

[56] References Cited

FOREIGN PATENT DOCUMENTS 0056874 10/1985 European Pat. Off. .

0242763 10/1987 European Pat. Off. ..... 83/93

*Primary Examiner*—Donald R. Schran

*Attorney, Agent, or Firm*—Peter K. Kontler

[57] ABSTRACT

Apparatus for cutting stacks of sheets has a first cutting machine which subdivides large piles of overlapping sheets into elongated strip-shaped stacks. The stacks are accumulated on a platform which is moved into a second cutting machine wherein a selected number of stacks is pushed by a feeding device across the cutting plane of a guillotine type knife before the knife descends to separate smaller stacks which come to rest on a plate or enter a gap formed in response to retraction of the plate so that the severed portions of the stacks can be advanced to a processing machine. The stacks which are about to be severed are pushed by a biasing device against a stop which extends at right angles to the cutting plane in the second machine, and each such stack is further pushed by an aligning device so that it abuts the feeding device. This ensures that the stacks are properly oriented prior to severing by the knife in the second machine. The effective length of the feeding device is less than the distance between the stop and the biasing device.

28 Claims, 6 Drawing Sheets

APPARATUS FOR CUTTING STACKS OF SHEETS

CROSS-REFERENCE TO RELATED CASE

The invention which is disclosed in the present case is related to that which is described in the commonly owned copending patent application Ser. No. 038,886 filed Apr. 15, 1987.

BACKGROUND OF THE INVENTION

The present invention relates to improvements in apparatus for cutting stacks of overlapping sheets which are made of paper, cardboard, paperboard, plastic material and/or metallic material. More particularly, the invention relates to improvements in apparatus which employ so-called guillotine type cutting or severing machines wherein a knife holder and a hold-down device for stacks are located above the cutting station and are caused to descend so that the hold-down device holds the sheets of the stack or stacks against stray movements and the knife on the holder thereupon subdivides each stack at the cutting station into smaller stacks.

Commonly owned European Pat. No. 0 056 874 discloses an apparatus wherein stacks of overlapping sheets of paper or other material are subdivided by a guillotine type knife. The arrangement is such that the stacks which are to be severed are moved to desired positions by a manually operated angled tool so that they abut suitable stops. Such mode of operating the apparatus is reliable; however, the apparatus requires constant attention especially if the orientation of stacks is to be changed upon completion of each cutting step. The European patent already discloses automatic positioning of a stack in the longitudinal direction and the formation of a gap which serves to permit an aligning device to move from a retracted position beneath the support for stacks to a raised position in which the aligning device can move one or more stacks against the device which feeds the stack or stacks to the cutting station. The feeding device extends along the full width of the cutting machine. The alignment or orientation which is achieved with such aligning device is wasted, in part, because each cutting step is preceded by a renewed shifting of the stack or stacks.

OBJECTS AND SUMMARY OF THE INVENTION

An object of the invention is to provide a novel and improved apparatus wherein the stacks of sheets which are to be severed can be oriented in a reliable way and with a high degree of reproducibility.

Another object of the invention is to provide the apparatus with novel and improved means for automatically feeding, orienting, holding and evacuating stacks of overlapping sheets in a time-saving operation.

A further object of the invention is to provide the apparatus with novel and improved means for aligning the stacks to be cut in several directions including in parallelism with and at right angles to the plane of the cutting tool.

An additional object of the invention is to provide the apparatus with a novel and improved guillotine type cutting or severing machine.

Still another object of the invention is to provide a novel and improved method of repeatedly subdividing piles and stacks of overlapping sheets in a time-saving operation and with a heretofore unmatched degree of accuracy and reproducibility.

A further object of the invention is to provide the apparatus with novel and improved means for feeding stacks to be severed to the cutting station of a guillotine type cutting machine.

Another object of the invention is to provide a novel and improved apparatus for forming stacks of labels or similar sheet-like products.

An additional object of the invention is to provide the apparatus with novel and improved means for facilitating removal of trimmed material from the cutting station and with novel and improved means for evacuating subdivided portions of stacks from the cutting station.

Another object of the invention is to provide the apparatus with novel and improved means for supporting, storing and transporting stacks between two cutting machines.

The invention is embodied in an apparatus which is used to subdivide stacks of overlapping sheets of paper, metal and/or plastic material. The apparatus comprises a support which includes a stack receiving first section, a second section which serves for reception of severed stacks or portions of severed stacks, and a working section which is disposed between the first and second sections. The apparatus further comprises a knife which is disposed above the working section and is movable by a suitable holder downwardly toward the working section to sever one or more stacks which are supported by the working section in such a way that the portions to be severed extend beyond the predetermined cutting plane of the knife and toward or onto the second section, a lateral stop for stacks which is disposed at the working station and extends substantially at right angles to the cutting plane, means for feeding stacks from the first onto the working section of the support in substantial parallelism with the stop, means for biasing the stacks against the stop, and means for automatically moving the biasing means against the stack or stacks on the working section in the direction of the cutting plane and toward the stop. The biasing means is spaced apart from the stop and the feeding means has an effective length which is less than the distance between the biasing means and the stop.

The feeding means can include a row of neighboring stock advancing segments, and the effective length of the row is variable. This row extends in parallelism with the cutting plane. for example, at least some segments of the row are movable to and from operative positions of engagement with one or more stacks on the first section of the support to transfer such stack or stacks onto the working section in such positions that the portions to be severed extend beyond the cutting plane. The feeding means can comprise a pivot member which extends at right angles to the stop and the segments of the feeding means are pivotable about the axis of such pivot member between their operative positions and inoperative positions in which they are preferably located above and away from the stack or stacks on the first section of the support.

The apparatus further comprises a hold-down device for pressing the stack or stacks on the working section against the working section in a region which is preferably immediately adjacent the cutting plane. The segments of the feeding means and the hold-down device can be provided with complementary teeth and tooth spaces. The teeth of the segments which are held in operative positions are received in the respective tooth spaces upon completed transfer of one or more stacks from the first section onto the working section of the support. The hold-down device is preferably disposed between the cutting plane and the feeding means. The arrangement is preferably such that the hold-down device is movable to and from a raised position above the stack or stacks on the working section, and the feeding means is movable beneath the hold-down device, while the latter is held in raised position, before the feeding means is moved toward the cutting plane to push one or more stacks to proper position or positions for severing.

Means is preferably provided for supplying stacks to the first section in a direction which is parallel to the cutting plane, and the first section can comprise a mobile platform. Retaining means can be provided for exerting pressure from above upon those stacks on the first section of the support which are not about to be severed, and the feeding means is preferably disposed between such retaining means and the stop.

The entire feeding means can be lifted above and away from the first section, and the lifted feeding means is thereupon movable in a direction away from the cutting plane so as to be ready for movement to a position behind a selected number of stacks on the first section preparatory to shifting of such stack or stacks toward and across the cutting plane.

The stop is preferably movable from an operative position to a raised position above the platform which forms part of or constitutes the first section of the support. Furthermore, the stop can be formed with a gap, and such apparatus further comprises an insert or filler which is movable with the knife holder between a position in the gap while the knife is located above the stack or stacks on the working section, and a position beneath the support while the knife is in the process of severing the stack or stacks on the working section.

The biasing means and/or the feeding means and/or the stop can include one or more fingers which tend to rest by gravity on the respective section or sections of the support.

A severing machine is preferably provided to subdivide each of a series of piles of overlapping sheets into a plurality of parallel stacks, and such apparatus further comprises means for transporting selected numbers of stacks of a plurality of parallel stacks onto the first section of the support for engagement by the feeding means.

The apparatus preferably further comprises an elongated aligning device which is disposed above the second section of the support and extends in substantial parallelism with the cutting plane, and means for moving the aligning device toward the cutting plane against that portion of a single stack or against those portions of several stacks which overlie the second section of the support prior to severing so that the stack or stacks on the working section are urged against the feeding means. The aligning device is preferably pivotable about an axis which is parallel to the cutting plane and is adjacent the second section of the support so that the aligning device can yield by pivoting in a first direction in response to penetration of a normally wedge-like knife into the stack or stacks on the working section and the aligning device can thereupon change the shape of the severed portion or portions upon retraction of the knife by pivoting in a second direction counter to the first direction. The aligning device can be provided or can cooperate with means for biasing the portion(s) of one or more stacks on the second section toward the second section.

Means can be provided to move the second section of the support away from the working section so as to establish a passage for evacuation of trimmed material by gravity or for transfer of severed portions of stacks to one or more processing machines. Ejector means can be provided to move severed portions of stacks in the longitudinal direction of the passage, namely in parallelism with the cutting plane.

The apparatus can further comprise auxiliary aligning means which is movable to a position above the passage so that severed portions of stacks on the second section are then disposed between the aligning device and the auxiliary aligning means. Means is preferably provided to move the auxiliary aligning means through the passage to an operative position at a level above the second section of the support and an inoperative position beneath the passage.

The apparatus can further comprise a doctor or other suitable means for stripping the material of stacks (e.g., trimmed surplus material) off the knife. The knife holder is arranged to move the knife upwardly while the knife is engaged by the stripping means so that the material which tends to adhere to the knife is stripped off the knife and descends into the passage. The stripping means is or can be mounted on the auxiliary aligning means and is preferably movable by a motor toward and away from an inclined surface of the preferably wedge-like knife before the knife begins to move upwardly. The aligning device and/or the auxiliary aligning means can include one or more fingers which tend to descend by gravity against one or more sections of the support.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
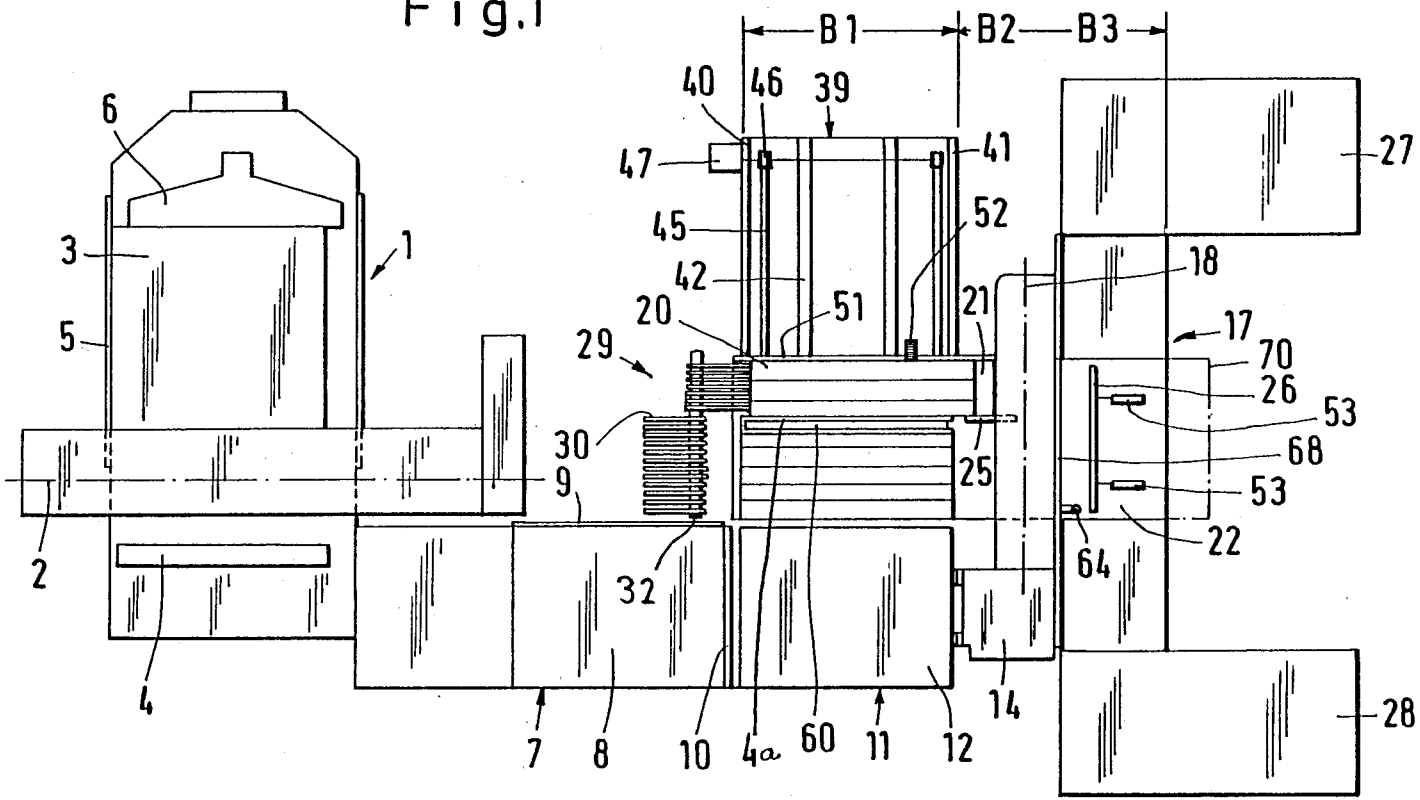
FIG. 1 is a schematic plan view of an apparatus with two cutting machines which embodies the invention.
Figures 8, 9, 10, 11, 12, 13, 14, 15, 16, 17, 18:
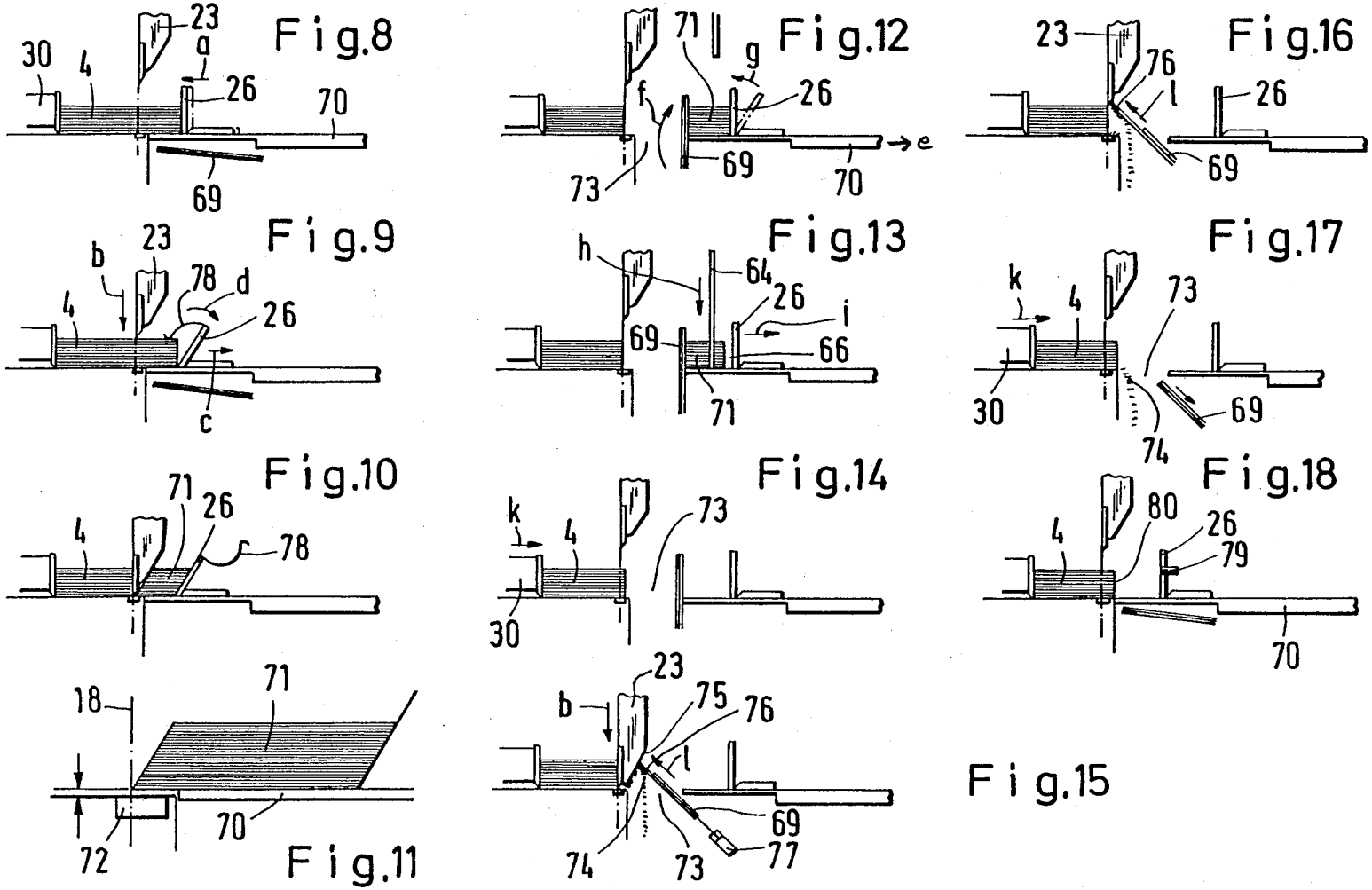
FIG. 8 illustrates a first stage of a cutting operation in the second cutting machine while the stack or stacks on the support of the second machine are being moved toward the adjacent portions of the feeding means.
FIG. 9 shows the next stage with the aligning device pivoted away from the adjacent edge face of the stack at the cutting station of the second machine.
FIG. 10 shows a further stage involving actual separation of a smaller stack from a stack at the cutting station.
FIG. 11 is an enlarged view of a detail in FIG. 10 and shows the separated portion of a stack in a slightly raised position.
FIG. 12 illustratates a further stage upon movement of the second section of the support away from the working section to define a passage or gap for evacuation of the freshly formed smaller stack.
FIG. 13 shows the structure of FIG. 12 and an ejector in an operative position behind the freshly formed smaller stack.
FIG. 14 shows the structure of FIG. 8 with the parts in positions they assume for trimming a stack in the second machine.
FIG. 15 shows the actual trimming operation and a stripping device which serves to remove surplus sheet material from the knife holder.
FIG. 16 shows a further stage of the trimming operation.
FIG. 17 shows an additional stage of the trimming operation.
FIG 18 shows the second section of the support in operative position preparatory to cutting of one or more fresh stacks or preparatory to renewed cutting of one or more partially subdivided stacks.

Referring first to FIG. 1, there is shown an apparatus which serves to subdivide relatively large piles 3 of overlapping sheets of paper, cardboard, plastic or metallic material first into elongated stacks 4 and to thereupon subdivide stacks 4 into smaller portions or stacks 71 (FIG. 10). The means for subdividing successive piles 3 into elongated stacks 4 comprises a first severing or cutting machine 1 wherein a pile 3 comes to rest on a horizontal support and one of its lateral edge faces is held in abutment with a lateral stop 5. A suitable pusher 6 is provided to advance the pile 3 stepwise through increments of selected length (corresponding to the width of a stack 4) along the stop 5 and across a cutting plane 2 which is defined by a guillotine type knife (not specifically shown). The rate of feed of the pile 3 into the range of the knife is variable.

Successively formed stacks 4 are gathered on a mobile platform 8 at a loading station 7 so that the platform accumulates a group of parallel stacks 4, e.g., a group which is obtained as a result of complete subdivision of a pile 3. The platform 8 cooperates with two elongated abutments 9 and 10 which facilitate the orientation of stacks 4 in optimum positions in such a way that the stacks are parallel to the abutment 9 and extend at right angles to the abutment 10. When the platform 8 is fully loaded, it is shifted in a direction to the right, as seen in FIG. 1, subsequent to slight retraction of the abutment 9 (upwardly, as seen in FIG. 1) and a lowering of the abutment 10 at right angles to the plane of FIG. 1 so that the platform 8 and the stacks 4 thereon can advance at a level above the lowered abutment 10. It is equally possible to raise the abutment 10 to a level above the platform 8 and the stacks 4 thereon.

Figure 5:
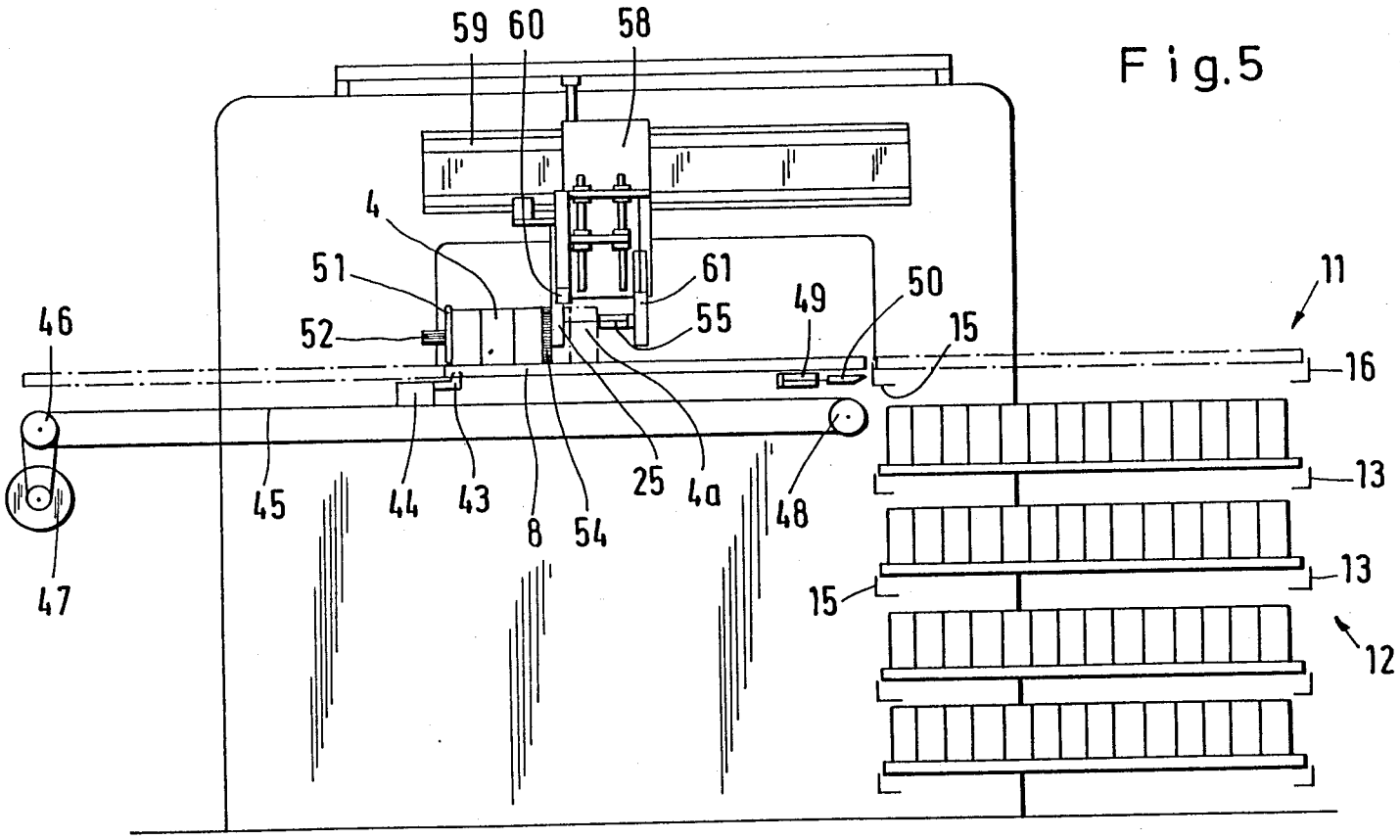
FIG. 5 is a schematic rear elevational view of the apparatus, with the feeding means removed.

The loaded platform 8 is advanced to a transfer station 11 where it can enter one of several storeys 13 of a vertically movable magazine 12 for a desired number of loaded platforms. FIG. 5 shows a magazine 12 with a total of four storeys 13; however, the number of such storeys can be much higher or less than four without departing from the spirit of the invention. A lifting unit 14 (e.g., one or more fluid-operated cylinder and piston assemblies) is provided to move the magazine 12 to a desired level, namely to a level at which a loaded platform 8 can enter an empty storey 13 or a loaded platform 8 can be withdrawn from a full storey 13. Each storey 13 is provided with at least two spaced parallel guide rails 15, 16 for the marginal portions of a loaded platform 8 which can be said to constitute a pallet for temporary storage and transport of arrays of stacks 4. The magazine 12 can be provided with idler rollers and/or other suitable means for adequately supporting the platforms 8 in the respective storeys 13 as well as for permitting convenient and predictable advancement of loaded platforms into and from selected storeys. The transfer station 11 is defined by that storey 13 of the magazine 12 which is located at the level of the loading station 7, i.e., which can receive a loaded platform 8 from the station 7 or from which a loaded platform can be withdrawn for delivery into a second cutting or severing machine 17.

The second cutting or severing machine 17 is immediately adjacent the transfer station 11 and its knife 123 (FIG. 7) is designed to sever selected numbers of stacks 4 in a cutting plane 18 which extends at right angles to the plane 2 of the cutting edge of the knife in the first cutting machine 1. The machine 17 comprises a composite support 19 including a first section 20 which is defined by one of the platforms 18, a second section 22 which receives severed portions 71 of the stacks 4, and a working section 21 which is disposed between the sections 20 and 22. The section 20 receives selected numbers of stacks 4 from the transfer station 11, and the section 21 is disposed at a level below the holder 23 for the vertically reciprocable guillotine type knife 123 (FIG. 8) whose cutting edge is located in the plane 18. The sections 20, 21 and 22 of the support 19 respectively occupy the zones or regions B1, B2 and B3. The knife holder 23 is adjacent a hold-down device 24 (FIG. 6) which serves to press upon the stack or stacks 4 on the working section 21 immediately adjacent the cutting plane 18 so as to prevent undesirable stray movements of sheets which form the stack or stacks 4 at the severing station of the second cutting machine 17.

The second machine 17 further comprises novel and improved means 25 for biasing selected numbers of stacks 4 on the section 21 against a lateral stop 51. An aligning device 26 is disposed at a level above the section 22 and is movable at right angles to the plane 18 to push the stacks 4 against a feeding means 29.

Those portions (71) of stacks 4 which have been severed by the knife 123 can be delivered to a first processing machine 27 (e.g., a bundling or baling machine for stacks of labels) or to a second processing machine 28 (e.g., a stamping machine). The severed portions 71 of stacks 4 can be delivered first to the stamping machine 28 and thereupon to the machine 27, first to the machine 28 and thereupon to storage, first to the machine 27 and thereupon to storage, or to a conveyor for shipment to the locale of use.

Figure 3:
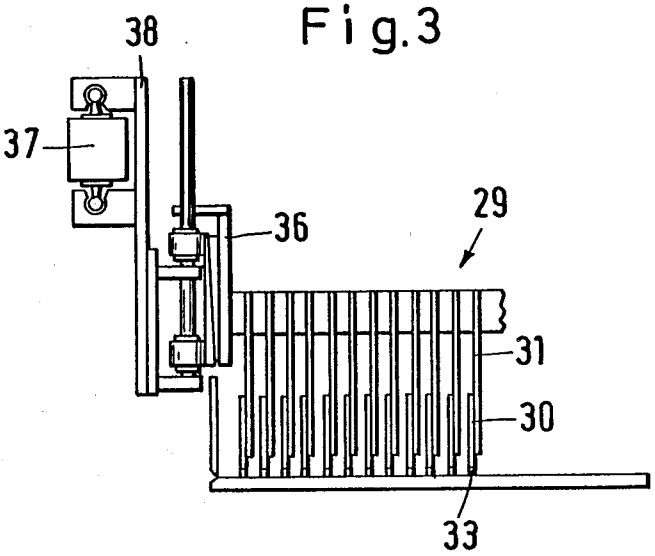
FIG. 3 is a view as seen from the right-hand side of FIG. 2.
Figure 2:
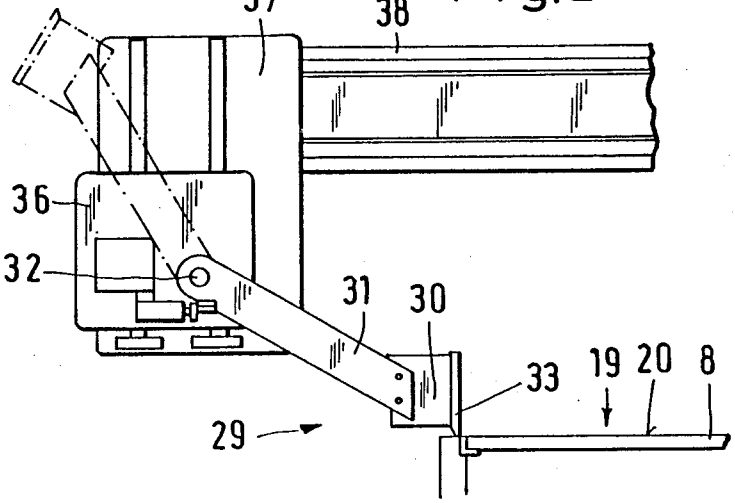
FIG. 2 is an enlarged side elevational view of means for feeding stacks of sheets in the second machine.
Figure 4:
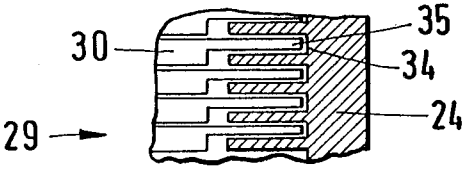
FIG. 4 is a fragmentary plan view of the feeding means and a fragmentary horizontal sectional view of the hold-down device in the second cutting machine.

The feeding means 29 serves to transfer selected numbers of stacks 4 from the section 20 onto the working section 21 in such positions that portions of the stacks extend beyond the cutting plane 18 and onto the section 22. The feeding means 29 comprises segments or portions 30 which form a row extending in parallelism with the cutting plane 18 and mounted on discrete lever arms 31 (FIGS. 2 and 3) for movement between operative positions on the section 20 and inoperative positions (indicated in FIG. 2 by phantom lines) in which they are disposed at a level above and are spaced apart from the section 20. All of the lever arms 31 are pivotable about the axis of a horizontal pivot member 32 which is parallel to the cutting plane 18 and to the upper surface of the section 20. As shown in FIG. 2, each of the segments 30 has one or more fingers 33 which tend to rest by gravity on the upper side of the section 20, i.e., on the respective platform 8. Each segment 30 has a tooth 35 (FIG. 4) which is receivable in the corresponding tooth space 34 of the hold-down device 24 when the latter bears upon the topmost sheet or sheets of the stack or stacks 4 at the severing station of the cutting machine 17. The segments 30 can be pivoted by hand or automatically by a suitable mechanism which is not shown in the drawing. For example, each segment 30 can be pivoted by a discrete motor which can receive actuating impulses from a control panel, not shown. By moving a selected number of segments 30 to their operative positions, the person in charge determines the number of stacks 4 which can be shifted relative to the respective platform 8 so as to move across the cutting plane 18 and be ready to be severed by the cutting edge of the knife 123 when the latter descends in response to downward movement of its holder 23. The fingers 33 can be made of a relatively heavy metallic material so that they tend to rest on the section 20 as soon as the respective segments 30 assume their operative positions corresponding to the solid-line position of the segment 30 which is shown in FIG. 2. The mutual spacing of neighboring teeth 35 which form part of the segments 30 is the same as the mutual spacing of neighboring tooth spaces in the hold-down device 24 of the cutting machine 17.

The feeding means 29 is mounted on a first slide or carriage 36 which is movable up and down relative to a second slide or carriage 37. The latter is reciprocable along horizontal guide members 38 (e.g., fixed rails) which are installed in the frame of the improved apparatus. By moving upwardly relative to the carriage 37, the carriage 36 can lift the feeding means 29 above the level of stacks 4 on the section 20 and, by moving rearwardly with the carriage 37 along the guide members 38, the feeding means 29 can reassume its starting position behind a selected number of stacks 4 on a platform 8 which constitutes the section 20 of the support 19. The motors which serve to move the carriage 36 up and down along the carriage 37 and to move the carriage 37 along the guide members 38 are not shown in the drawing. Such motors can receive start and stop signals from a suitable programming unit, not shown.

A selected loaded platform 8 which is to form the section 20 of the support 19 is movable along a track 39 including two guides 40, 41 which are parallel to the cutting plane 18. The track 39 can further include one or more additional guides 42 in order to ensure predictable guidance of the platform 8 which is caused to leave the respective storey 13 of the magazine 12 and to advance to a position adjacent the working section 21 of the support 19. The means for moving a selected loaded platform 8 to the position of alignment with the working section 21 comprises a coupling device 43 whose hook-shaped portion can enter a recess or socket at the underside of the selected platform 8 (see FIG. 5) and which is mounted on an endless chain conveyor 45. The latter is trained over a driver sprocket wheel 46 and a driven sprocket wheel 48, and the sprocket wheel 46 is arranged to be driven by a reversible motor 47. When the coupling device 43 engages a loaded platform 8, the motor 47 is started to drive the chain 45 in a direction to advance the loaded platform from the transfer station 11 into the second cutting machine 17. A suitable servomotor (not specifically shown) is provided to pivot the coupling device 43 into and from engagement with a platform 8. This coupling device 43 is pivotably mounted in a housing 44 which is attached to the chain 45 and which also supports or confines the aforementioned servomotor.

The guide rails 15 in the storeys 13 of the magazine 12 can be lowered by a hydraulic or pneumatic cylinder and piston unit 49 or other suitable motor means so that they do not interfere with advancement of loaded platforms 8 from the respective storeys 13 under the action of the coupling device 43. The unit 49 has a wedge-like lowering element 50 which engages the adjacent guide rail 15 and pushes it downwardly while a loaded platform 8 advances from the respective storey 13 into the second cutting machine 17.

The aforementioned lateral stop 51 is adjacent a proximity detector switch 52 which monitors the track 39 for the presence or absence of stacks 4 and transmits a signal to stop the motor 47 as soon as it detects the adjacent side face of the foremost stack 4 on the platform 8 which is in the process of moving from its storey 13 into the cutting machine 17. Thus, the switch 52 ensures that the foremost stack 4 on the loaded platform 8 which has entered the cutting machine 17 comes to a halt in immediate proximity of the stop 51 which latter extends at right angles to the cutting plane 18. In fact, the arrangement may be such that the motor 47 is arrested when the foremost stack 4 has been advanced to a position of actual abutment with the stop 51. The leading portion of the platform 8 which advances along the track 39 is preferably provided with a wedge which lifts the stop 51 so that the platform 8 can advance beneath the thus lifted stop 51 until the switch 52 detects the foremost stack 4 on such platform (this foremost stack is the topmost stack as seen in FIG. 1).

In the next step, selected (operative) segments 30 of the feeding means 29 are caused to push the adjacent stack or stacks 4 toward and across the cutting plane 18 so that the portions 71 to be severed are located at the right-hand side of such plane (as seen in FIG. 1) and can be separated from the remaining portions of the respective stacks 4 in response to downward movement of the holder 23 and its knife 123. FIG. 1 shows that the three foremost stacks 4 on the section 20 of the support 19 are located in front of three operative segments 30 of the feeding means 29 and are shifted with reference to the remaining stacks 4 on the same platform 8 so that they are ready to be severed by the knife 123.

Figure 6A:
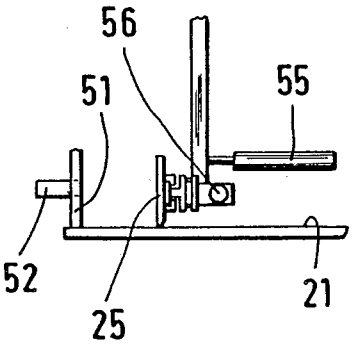
FIG. 6*a* shows a detail as seen from the right-hand side of FIG. 6.
Figure 6:
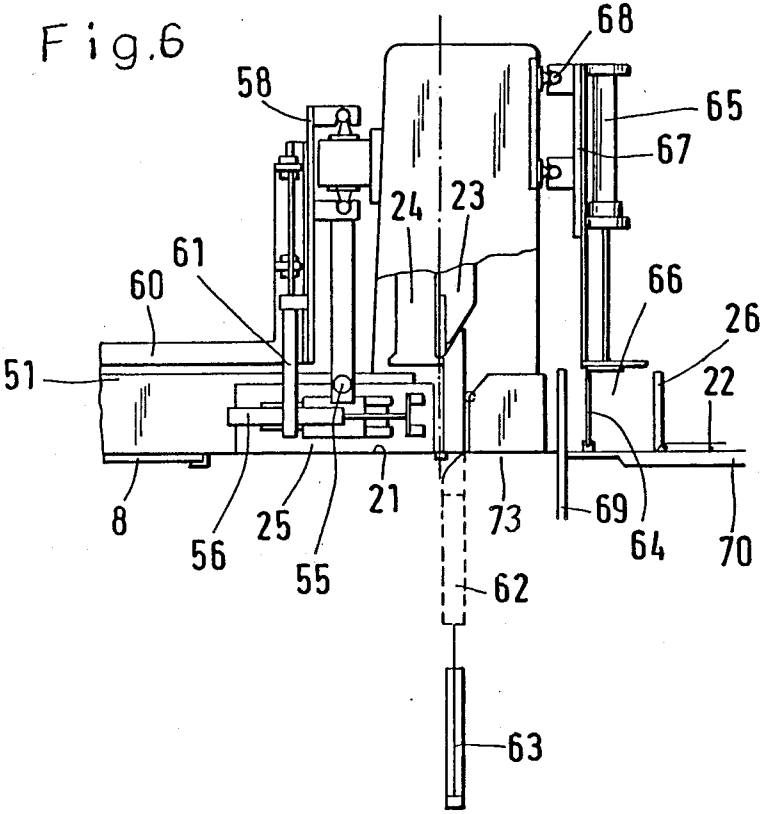
FIG. 6 is a schematic vertical sectional view of the second machine.
Figure 7:
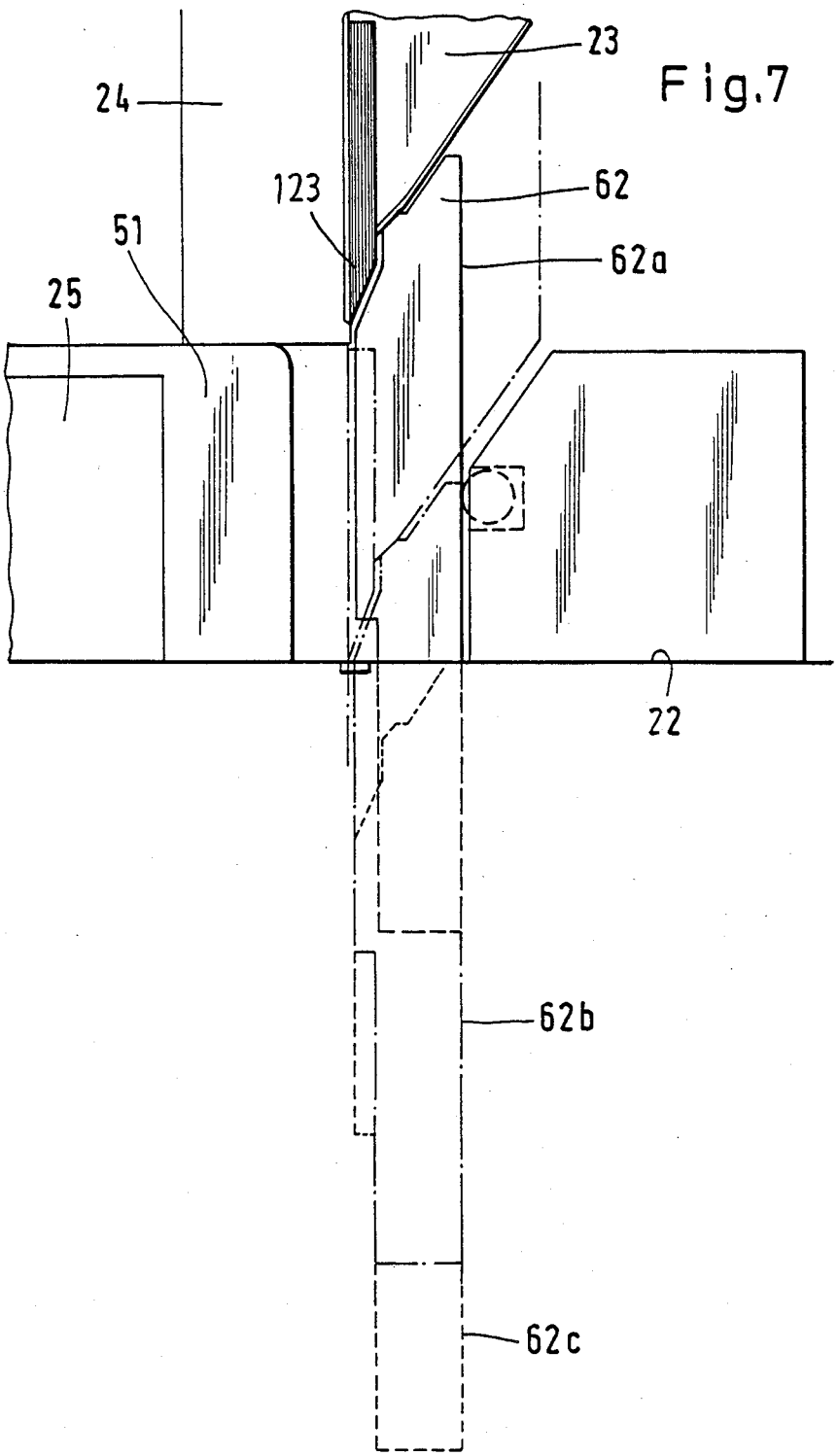
FIG. 7 is an enlarged fragmentary schematic vertical sectional view of the knife and knife holder and adjacent parts in the second cutting machine.

At such time, the biasing means 25 (which comprises fingers 54 shown in FIG. 5 and tending to rest by gravity on the section 21 of the support 19) urges the third stack 4 against the adjacent stack so that the three stacks which are about to be severed are caused to assume their optimum positions of parallelism with the stop 51 and at right angles to the cutting plane 18. The biasing means 25 is movable in parallelism with the plane 18 by a motor 55 (FIGS. 6 and 6*a*). The distance between the stop 51 and the biasing means 25 is greater than the effective length of the feeding means 29, i.e., the combined length of those segments 30 which are held in the operative positions is less than the distance between 25 and 51. The biasing means 25 is movable at a level below the raised hold-down device 24 of the machine 17 to and from the position which is shown in FIG. 1 partly by solid and partly by broken lines.

The motor 55 for the biasing means 25 is movable by a motor 56 which is mounted on a carriage 58 for movement along stationary horizontal guide rails 59 which are installed in the frame of the improved apparatus.

The motors 53, 55 for the aligning device 26 and for the biasing means 25 are preferably designed to repeatedly move such parts in directions toward the feeding means 29 and stop 51, respectively. This ensures accurate alignment and orientation of stacks 4 in the cutting machine 17 regardless of the consistency and/or number of sheets in a stack 4. If desired, the stack-contacting surfaces of the biasing means 25 and aligning device 26 can be coated with layers of elastic material.

The carriage 58 further supports a pressing or retaining element 60 which is movable downwardly by a motor 61 to bear against the topmost sheet of the stack 4*a* adjacent the last effective segment 30 of the feeding means 29. In other words, the effective portion of the feeding means 29 is disposed between the stop 51 and the retaining element 60. This can be seen in FIG. 1. The retaining element 60 is lowered onto the fourth stack 4*a* on the platform 8 which constitutes or forms part of the section 20 of the support 19 before the feeding means 29 is actuated to shift the three foremost stacks 4 of the array of stacks on such platform toward and across the cutting plane 18. This ensures that the orientation of stacks 4 which are not to be severed during a particular cycle but are already located in the cutting machine 17 remains unchanged in the course of the next-following severing operation as well as in the course of removal of severed portions of stacks from the machine 17.

Those segments 30 of the feeding means 29 which are held in their inoperative positions are spaced apart from the section 20 and from the hold-down device 24 so that they cannot interfere with the operation of the retaining element 60, with the operation of the biasing means 25 and/or with the operation of other components of the cutting machine 17.

The stop 51 is formed with a gap in order to ensure that the knife 123 and its holder 23 can perform downward strokes and sever the stack or stacks 4 which extend across the cutting plane 18. The gap is normally filled by a filler or insert 62 (FIG. 7) which can but need not be mounted on the knife holder 23. The filler 62 guarantees proper orientation of stacks 4 at the cutting station. When the knife holder 23 is still located at a level above the stacks 4 which are to be severed, the filler 62 is held in the solid-line position 62*a* of FIG. 7 in which it fills the gap between the two portions of the stop 51. When the holder 23 descends, the filler 62 is first moved to an intermediate position 62*b* and ultimately to a lower end position 62*c* (these positions are respectively indicated in FIG. 7 by phantom and dotted lines). When in the position 62*b*, the filler 62 prevents the knife 123 from shifting the severed portion 71 of a stack in its entirety in a direction to the right, as seen in FIG. 6. When it assumes the position 62*c*, the entire filler 62 is located at a level below the support 19 so that it allows for convenient removal of severed stacks from the cutting station even if each severed stack comprises a relatively small number of sheets. The means for moving the filler 62 in synchronism with the holder 23 for the knife 123 comprises a servomotor 63 which is shown in FIG. 6.

FIG. 6 further shows that the apparatus comprises an angled ejector 64 which is movable by a motor 65 in parallelism with the cutting plane 18 and is installed in a transverse channel 66. The motor 65 and the ejector 64 are mounted on a carriage 67 which is adapted to be driven by a further motor (not shown) along a stationary guide 68. The channel 66 is bounded by the aligning device 26 and by an auxiliary aligning means 69. The latter can be moved to the position of FIG. 6 when a plate-like member 70 which constitutes the second section 22 of the support 19 has been moved away from the working section 21 so that the sections 21 and 22 define a gap 73. The retracted position of the plate 70 is shown in FIG. 1 by phantom lines. The gap 73 allows for preferably automatic delivery of severed portions 71 of stacks 4 to the baling machine 27 or to the stamping machine 28.

The mode of operation of the apparatus of FIGS. 1 to 7 will be described with reference to FIGS. 8 to 18.

FIG. 8 shows that the aligning device 26 has been moved in the direction of arrow a so that it bears upon the first edge faces of stack 4 which extends across the cutting plane 18 and urges the rear edge face of such stack against the respective segment or segments 30 of the feeding means 29. As mentioned above, the motors 53 can be actuated repeatedly to move the aligning device 26 several times from the phantom-line position to the solid-line position of FIG. 8 in order to ensure that each and every sheet of the stack 4 on the platform 8 which constitutes the section 20 of the support 19 abuts the respective segment 30. The last stage of the just described aligning operation by the device 26 is followed by a movement of the biasing means 25 toward the stop 51 so that the stack 4 on the section 20 abuts flush against the stop 51 prior to start of the cutting operation, i.e., prior to descent of the holder 23 and knife 123. The actual cutting operation is preceded by a downward movement of the hold-down device 24 to rest upon and to bear against the stack 4 adjacent the cutting plane 18, i.e., in front of the the operative segments or segments 30 of the feeding means 29.

FIG. 9 shows the cutting edge of the knife in the holder 23 at a level immediately above the stack 4 at the severing station of the machine 17, i.e., the knife holder 23 moves in the direction of arrow b. At the same time, the alignment device 26 is permitted or caused to pivot in the direction of arrow d about an axis which is parallel to the cutting plane 18 and is adjacent the upper side of the plate 70 which constitutes the second section 22 of the support 19. Such pivoting of the aligning device 26 preferably takes place simultaneously or immediately after a retraction of the device 26 (arrow c) from the solid-line to the phantom-line position of FIG. 8. A pivotal movement of the aligning device 26 to the inclined position of FIG. 9 is desirable because the knife holder 23 normally resembles a wedge and effects the conversion of severed portion 71 of the stack 4 at the severing station into a parallelepiped body having two lateral surfaces which are inclined with reference to the cutting plane 18.

FIG. 10 shows the knife on the holder 23 in the course of the severing operation. A resilient retaining device 78, which is mounted on or is movable with the aligning device 26, has been moved from the operative position of FIG. 9 (in which it bears upon the topmost sheet of the stack 4 which is being severed) to an inoperative position remote from the severed portion 71 of the stack. The alignment device 26 abuts against and supports the right-hand edge face of the freshly severed portion 71 which rests on the plate 70 (i.e., on the second section 22 of the support 19). The parallelepiped shape of the portion 71 is attributable primarily to the wedge-like configuration of the holder 23 for the knife 123.

In the next step, the plate 70 is raised by a distance x (e.g., 1 mm) above the level of the upper side of an anvil 72 for the knife 123 in order to ensure that the severed portion 71 is completely separated from the remainder of the stack 4. This is shown in FIG. 11.

FIG. 12 shows the plate 70 in a retracted position in which the sections 21 and 22 of the support 19 define the aforementioned passage or gap 73 immediately adjacent the cutting plane 18. The passage develops in response to rightward movement of the plate 70 (arrow e) through a predetermined distance. At the same time, the auxiliary aligning means 69 is pivoted into the passage 73 in the direction of arrow f from a position of rest at a level below the support 19 to a position in which it cooperates with the aligning device 26 to flank the freshly separated portion 71. In addition, the aligning device 26 is pivoted in the direction of arrow g so that the portion 71 is converted into a small stack which is bounded by four upright edge faces.

In the next step (FIG. 13), the angled ejector 64 is moved downwardly in the direction of arrow h into the space 66 between the aligning device 26 and the auxiliary aligning means 69 so that it is located behind the smaller stack 71 and can shift such smaller stack to the processing machine 27 or 28. It is preferred to move the aligning device 26 slightly away from the smaller stack 71 (arrow i). The operation of the ejector 64 is preferably automated so that the smaller stack 71 reaches the machine 27 or 28 without any assistance on the part of the attendant who is primarily concerned with the operation of the first cutting machine 1.

If the stack or stacks 4 which extend across the cutting plane 18 merely require a trimming rather than a subdivision into smaller stacks 71, a stack 4 to be trimmed is moved to the position of FIG. 14 before the knife 123 descends with its holder 23 so that the trimmed surplus 74 of the material of a stack 4 is free to descend into the passage or gap 73 between the sections 21 and 22 of the support 19. The stack 4 assumes the position of FIG. 14 in response to forward movement (arrow k) of the respective aligned segment 30 while the plate 70 is held in the retracted position to define the passage 73. The severed surplus 74 descends into and downwardly beyond the passage 73 (e.g., into a collecting receptacle, not shown) primarily in response to upward (return) movement of the knife 123 back to its starting or raised position. This can be seen in FIG. 15 which further shows an optional but desirable stripping device 76 (e.g., a doctor-like blade) which is mounted on and is movable relative to the auxiliary aligning means 69 by a suitable motor 77 so that it bears against the inclined surface 75 of the knife 123 and/or holder 23 while the latter moves upwardly back to its starting position. The auxiliary aligning means 69 is preferably held in a position at right angles to the plane of the inclined surface 75 of the holder 23. The direction in which the stripping device 76 is movable by the motor 77 to engage the surface 75 is indicated by the arrow 1. The purpose of the stripping device 76 is to ensure reliable separation of all surplus material 74 from the knife 123 and its holder 23. FIG. 16 shows the holder 23 during upward movement back to its starting (raised) position. A further forward movement of the segment or segments 30 in the direction of arrow k (FIG. 17) even more reliably ensures that all surplus material descends into the passage 73. The aligning device 26 is retracted to the position of FIG. 17 and the plate 70 is caused to close the passage 73 (FIG. 18). The apparatus is then ready for the next severing operation, i.e., to separate portions 71 from stacks 4 which were merely trimmed or already relieved of portions 71 during a preceding stage of operation, or to remove portions 71 from freshly supplied stacks 4. This involves a forward movement of one or more stacks 4 all the way to or into close proximity of the retracted aligning device 26.

When the subdivision of a set of three foremost stacks 4 into smaller stacks or portions 71 is completed, the motor 47 is started again to move the chain 45 with the housing 44 and coupling device 43 in a direction to advance a fresh set of stacks 4 into the cutting machine 17, i.e., in front of a corresponding number of operative segments 30 of the feeding means 29. This involves a movement of the platform 8 at the transfer station 11 in a direction to the left, as seen in FIG. 5. The proximity detector switch 52 detects the foremost oncoming stack **4*a* and arrests the motor 47 when the foremost stack 4*a* reaches or is close to the stop 51**.

The just described advancement of the platform 8 by way of the motor 47 and chain 45 is preceded by or takes place simultaneously with a return movement of the feeding means 29 to its starting position to the left of the stack **4*a*, as seen in FIG. 1. This is achieved by lifting the feeding means 29 by way of the carriage 36 and by thereupon actuating the motor for the carriage 37 so that the carriage 36 and the feeding means 29 thereon are returned to their starting positions. The feeding means 29 is then lowered by the carriage 36 to move one or more segments 30 into register with the foremost stack or stacks 4 on the adjacent platform 8, and the carriage 37 then moves the carriage 36 and the feeding means 29 toward the cutting plane 18 in order to advance one or more stacks 4 to positions for severing by the knife 123. The same procedure is repeated again and again until the supply of stacks 4 on the platform 8 which constitutes or forms part of the section 20 is exhausted. The coupling device 43 is then actuated to transfer the empty platform 8 into an empty storey 13 of the magazine 12 before the magazine 12 is raised or lowered in order to move a loaded platform 8 into the range of the coupling device 43**.

The operation of the second cutting or severing machine 17 is or can be automated to a desired extent. This ensures that the entire apparatus can be attended to by a single person who is concerned primarily with the servicing of the machine 1 and merely monitors the operation of the machine 17. The single attendant can be charged with manipulation of the controls for the machine 1 and with proper arraying of stacks 4 on the platform 8 which occupies the loading station 7.

The apparatus of FIGS. 1 through 18 can be modified in a number of ways. For example, each freshly loaded platform 8 can be immediately delivered into the machine 17 to perform the function of the section 20, and each empty platform 8 can be evacuated from the machine 17 by moving it upwardly (as seen in FIG. 1) beyond the guide means 40, 41, 42 of the track 39.

The resilient retaining device 78 (FIG. 9) is desirable and advantageous if the machine 17 is to cut stacks of sheets which consist of a brittle material. The exact construction of such retaining device 78 will depend on the nature of the material of the sheets which are being severed. The retaining device 78 ensures that the sheets of portions 71 are held against stray movements in the course of the severing operation and, if desired, upon completion of the severing operation. If the nature of sheets which form the stacks 4 is such that they need not be held by the retaining device 78, the latter is simply pivoted or otherwise moved out of the way, e.g., to the position which is shown in FIG. 10.

FIG. 18 shows a proximity detector 79 which is provided on the aligning device 26 and generates a signal when it is approached by the front edge face 80 of the adjacent stack 4. The signal from the detector 79 is used to arrest the motor for the carriage 37, i.e., to stop the feeding means 29 in time before the stack or stacks 4 which are being pushed by the feeding means 29 actually strike against the aligning device 26. This ensures a more predictable positioning of stacks 4 for cutting by the knife 123 and allows for additional automation of operation of the cutting machine 17. Moreover, this renders it possible to dispense with or to disconnect the motors 53 for the aligning device 26.

A slip clutch can be installed in the power train between the carriage 37 and the respective motor which serves to move the carriage along the guide means 38 so as to ensure that the feeding means 29 can come to a halt if it encounters an obstacle on its way toward engagement with the adjacent stack or stacks 4 on the platform 8 which constitutes or forms part of the section 20. Furthermore, such slip clutch enables the feeding means 29 to come to a halt if the stack or stacks 4 which are being pushed by the feeding means encounter a pronounced resistance to movement toward and across the cutting plane 18.

Some or all of the motors which are used in the apparatus of FIGS. 1 to 18 are or can constitute fluid-operated (hydraulic or pneumatic) cylinder and piston units. However, it is clear that such fluid-operated motors can be used jointly with or can be replaced by other types of motors such as electric motors, electromagnets, suitable transmissions which receive motion from a main prime mover and/or others.

The improved apparatus exhibits the advantage that the effective length of the feeding means 29 (as seen in the longitudinal direction of the cutting edge of the knife 123 and at right angles to the stop 51) is less than the distance between the stop 51 and the biasing means 25. Therefore, the biasing means 25 can remain in a given position without risking a collision with the feeding means 29. The distance which the biasing means 25 must cover in order to properly orient one or more stacks 4 with reference to the stop 51 is very short and, therefore, the alignment of one or more stacks 4 with reference to the stop 51 can be completed within a very short interval of time. Since the movements of the biasing means 25 are preferably initiated and effected by automatic means, the timing of a movement of the biasing means 25 can be readily selected in such a way that it immediately precedes the next-following cutting step. All in all, the apparatus can complete the alignment of one or more stacks 4 in parallelism with the support 51 within a small fraction of the time which is required in a conventional apparatus wherein the alignment is carried out by hand, by a manually operated tool or by heretofore known motorized aligning means. Therefore, the output of the apparatus is very high even if the feeding means 25 must be shifted prior to each and every cut.

An advantage of the feeding means 29 is that its effective length or width (as measured at right angles to the longitudinal direction of the stop 51) can be varied in a simple and time-saving manner so as to conform the effective width to the number of stacks 4 which are to be advanced across the cutting plane 18. It is also within the purview of the invention to provide the apparatus with a set of exchangeable feeding means; however, the illustrated adjustable feeding means 29 is preferred at this time because it contributes to lower cost of the apparatus and allows for rapid conversion of the apparatus for the severing of different numbers and/or differently dimensioned stacks. The inactive segments or portions 30 can be removed from the apparatus but it is preferred to mount such segments for pivotal movement about an axis (of 32) which is normal to the longitudinal direction of the stop 51 so as to allow for rapid pivoting of selected segments between operative and inoperative positions. Once moved to inoperative positions, the segments 30 are out of the way and do not interfere with movements of the stacks 4 and/or feeding means 25.

The feature that the mutual spacing of tooth spaces 34 is the same as that of teeth 35 on the segments 30 of the feeding means renders it possible to interchange the segments 30 without risking collision when the segments are held in operative positions and the hold-down device 24 descends to bear upon the topmost sheet or sheets of the stack or stacks 4 on the section 21 of the support 19. Moreover, the hold-down device 24 can cooperate with the feeding means 29 irrespective of the number of segments 30 which are held in operative positions. The placing of the biasing means 25 at a level above the section 21, close to the cutting plane 18 and behind the plane of the hold-down device 24 is desirable and advantageous because this ensures that the stacks 24 are engaged and oriented by the biasing means in close proximity of the plane 18. If the orienting of stacks 4 is to be carried out with a very high degree of accuracy, the biasing means 25 is first moved beneath the raised hold-down device 24 and thereupon in a direction toward the stop 51. This renders it possible to place the biasing means 25 even closer to the cutting plane 18.

The placing of the path for transfer of loaded platforms 8 from the station 7 to the station 11 behind the biasing means 25 ensures that a loaded platform does not collide with the biasing means and vice versa. The stacks 4 which rest on their platform 8 are preferably oriented at the station 7 so that their orientation approximates the desired optimum orientation; this reduces the amount of time which is required for accurate or final orientation of stacks on the section 20 of the support 19. Additional preliminary orientation of stacks 4 on a moving platform 8 can take place in response to engagement of the foremost stack 4 with the stop 51, especially if the detector switch 52 is set to arrest the motor 47 in response to actual engagement between the exposed laeeral edge face of the foremost stack 4 and the adjacent surface of the stop 51.

The feature that the effective length of the feeding means 29 is less than the distance between the stop 51 and the biasing means 25 is desirable and advantageous on the additional ground that it is not always necessary to sever all of the stacks 4 on the section 20 of the support 19, i.e., that it is possible to sever relatively small numbers of stacks 4 which invariably results in a more accurate cutting operation. The retaining means 60 ensures that the stack or stacks 4 behind the rearmost operative segment 30 of the feeding means 29 do not change their positions during orientation of one or more stacks by the stop 51 in cooperation with the biasing means 25 and/or during orientation of such stack or stacks by the feeding means 29 in conjunction with the aligning device 26. The retaining means 60 is out of the way, i.e., it cannot interfere with movements of the feeding means 29, biasing means 25 and/or aligning device 26 even though it can engage the foremost stack 4 of that group or set of stacks on the section 21 which are not as yet ready to be severed by the knife 123.

An advantage of the carriages 36 and 37 is that they can move the feeding means 29 out of the way and back to its starting position while the motor 47 is in the process of advancing a platform 8 along the track 39 so as to move one or more stacks 4 into register with the operative segment or segments 30 of the feeding means. Such mode of manipulating a loaded platform 8 in the machine 17 and of manipulating the feeding means 29 contributes to a higher output of the apparatus. As mentioned above, the stop 51 is lifted (preferably automatically) prior to forward movement of a platform 8 along the track 39. This ensures that the platform 8 can be rapidly advanced to a desired position which is determined by the proximity detector switch 52.

The filler or insert 62 constitutes an optional but desirable and advantageous feature of the improved apparatus. This filler is located in the gap between the two parts of the stop 51 when the latter cooperates with the biasing means 25 to properly orient one or more stacks 4 on the section 20 but the filler is moved out of the way when the holder 23 descends. When in its lowermost position 62*b*, the filler 62 allows for removal of severed portions of stacks 4 in any desired direction including forwardly (i.e., upwardly as seen in FIG. 1). The utilization of the filler 62 is particularly desirable and advantageous when the stacks 4 must be subdivided into relatively small portions 71 each of which can constitute a stack of discrete labels or the like.

The aligning device 26 can be used in conjunction with or independently of the biasing means 25, i.e., an apparatus which embodies the present invention can be provided with the parts 29, 25 and 26, with the parts 29, 25 or with the parts 29 and 26. The aligning device 26 compensates for any stray movements of stacks 4 in a direction away from the segments 30 of the feeding means 29. Since the aligning device 26 is mounted at a level above the section 22 of the support 19, it does not interfere with forward movements of a fully or partly loaded platform 8 along the track 39 and/or with movements of the biasing means 25 toward the stop 51. As a rule, or in many instances, the sequence of steps will be selected in such a way that the aligning action of the device 26 takes place upon completion of aligning action which is carried out by the biasing means 25, but the sequence of these steps can be reversed without departing from the spirit of the invention. The aligning device 26 can be kept very close to the desired or anticipated positions of the foremost parts of stacks 4 which are about to be severed so that the device 26 can be moved toward the feeding means 29 with little loss in time and can be retracted, if necessary, prior to each and every cutting operation. Tilting of the aligning device 26 in a manner as shown in FIG. 9 is not absolutely necessary (the device 26 can be made of an elastic material) but is desirable and advantageous in order to avoid undesirable deformation of sheets which form the portions (smaller stacks) 71. By pivoting the aligning device 26 back to the upright position (arrow g in FIG. 12), one can cause each portion 71 to assume an optimum shape for transport to the machine 27, to the machine 28 or to another destination. It has been found that such pivotability of the aligning device 26 renders it possible to subdivide tall stacks 4 into a large number of relatively small stacks or portions 71 each of which contains a large number of accurately overlapping labels or the like.

The provision of auxiliary aligning means 69 and of the ejector 64 is particularly desirable and advantageous when the portions 71 (small stacks) contain relatively small sheets (e.g., small discrete labels). The manipulation of such small stacks is much simpler and more convenient by using the auxiliary aligning means 69 in combination with the main aligning device 26 and by using an automatic expelling device 64 for the stacks 71. The parts 64 and 69 are out of the way as long as the gap 73 remains closed, i.e., as long as the plate 70 dwells in the position of FIGS. 8 or 18.

The provision of fingers (such as 33 and 54) on the feeding means 29, on the biasing means 25, on the stop 51, on the aligning device 26 and/or on the auxiliary aligning means 69 to descend by gravity into abutment with the respective sections of the support 19 ensures that each and every sheet (including the lowermost sheet) of each stack 4 or stack portion 71 is properly shifted when the need arises.

The feature that the apparatus embodies two cutting machines 1 and 17 whose cutting planes (2 and 18) extend at right angles to each other, one of which subdivides large piles 3 of sheets into stacks 4 and the other of which subdivides and/or trims stacks 4, contributes to a higher output of the apparatus, especially if at least one of the cutting machines (particularly the machine 17) is operated automatically. This ensures that the output of the machine 1 is processed in the machine 17 at the rate at which the machine 1 turns out stacks 4. In fact, the output of the machine 17 can be so high that this machine can process stacks which are turned out by two or more machines 1. However, it is equally possible (especially if the operation of the first machine 1 is automated) to deliver the output of a single first machine 1 to two or more machines 17.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my to the art and, therefore, such adaptations should and are intended to be comprehended within the meaning and range of equivalence of the appended claims.

I claim:

1. Apparatus for subdividing stacks of overlapping sheets, comprising a support including a stack receiving first section, a second section for reception of severed stacks, and a working section between said first and second sections; a knife disposed above and movable downwardly toward said working section to sever the stack or stacks on the working section in a predetermined plane; a lateral stop for the stacks, said stop being disposed at said working section and extending at right angles to said plane; means for feeding stacks from said first onto said working section in substantial parallelism with said stop; means for biasing stacks on said working section against said stop; and means for automatically moving said biasing means against the stack or stacks at said working section in the direction of said plane and toward said stop, said biasing means being spaced apart from said stop and said feeding means having an effective width less than the distance between said biasing means and said stop.

2. The apparatus of claim 1, wherein said feeding means includes a row of neighboring stack advancing segments and the effective length of said row is variable, said row extending in parallelism with said plane.

3. The apparatus of claim 2, wherein at least some segments of said row are movable to and from operative positions of engagement with one or more stacks on said first section for transfer of such stack or stacks onto said working section.

4. The apparatus of claim 3, wherein said feeding means includes a pivot member which extends at right angles to said stop and said at least some segments are pivotable about the axis of said pivot member between said operative positions and inoperative positions above and away from the stack or stacks on said first section.

5. The apparatus of claim 3, further comprising a hold-down device arranged to press the stack or stacks against said working section adjacent to said plane, said segments and said hold-down device respectively having complementary teeth and tooth spaces and the teeth of those segments which are held in operative positions being received in the respective tooth spaces upon completed transfer of one or more stacks from said first section onto said working section.

6. The apparatus of claim 5, wherein said hold-down device is disposed between said feeding means and said plane.

7. The apparatus of claim 6, wherein said hold-down device is movable to and from a raised position above the stack or stacks on said working section and said feeding means is movable beneath said hold-down device in the raised position of the latter prior to moving toward said plane.

8. The apparatus of claim 1, further comprising means for supplying stacks to said first section in a direction which is parallel to said plane.

9. The apparatus of claim 1, wherein said first section includes a mobile platform.

10. The apparatus of claim 1, further comprising retaining means for exerting pressure from above onto stacks on said first section, said feeding means being disposed between said retaining means and said stop.

11. The apparatus of claim 1, further comprising means for lifting said feeding means above and away from said first section and for moving the lifted feeding means in a direction away from said plane.

12. The apparatus of claim 1, wherein said first section includes a mobile platform and said stop is movable from an operative position to a raised position above the level of said platform.

13. The apparatus of claim 1, wherein said stop has a gap and further comprising an insert for filling said gap, said insert being movable between a position in said gap while the knife is located above the stack or stacks on said working section and a position beneath said support while the knife is in the process of severing the stack or stacks on said working section.

14. The apparatus of claim 1, wherein said biasing means includes at least one finger which tends to rest by gravity on the working section of said support.

15. The apparatus of claim 1, further comprising a severing machine having means for subdividing each of a series of piles of overlapping sheets into a plurality of parallel stacks, and means for transporting selected numbers of stacks of a plurality of parallel stacks onto said first section of said support for engagement by said feeding means.

16. The apparatus of claim 1, wherein the portions of stacks to be severed overlie said second section, and further comprising an aligning device disposed above said second section and extending in substantial parallelism with said plane, and means for moving said aligning device toward said plane and against the portions of stacks on said second section so that the stacks are urged against said feeding means.

17. The apparatus of claim 16, wherein said aligning device is pivotable about an axis which is substantially parallel to said plane and is adjacent said second section so that the aligning device can yield by pivoting in a first direction in response to penetration of the knife into the stack or stacks on said working section and can change the shape of the severed portions of stacks upon retraction of the knife by pivoting in a second direction counter to said first direction.

18. The apparatus of claim 16, wherein said aligning device has means for biasing the portions of stacks of the second section toward said second section.

19. The apparatus of claim 16, further comprising means for moving said second section away from said working section so as to establish a passage between said second and working sections.

20. The apparatus of claim 19, further comprising ejector means for severed portions of stacks, said ejector means being movable along said passage in parallelism with said plane.

21. The apparatus of claim 19, further comprising auxiliary aligning means movable to a position above said passage so that the severed portions of stacks on said second section are disposed between said aligning device and said auxiliary aligning means.

22. The apparatus of claim 21, further comprising means for moving said auxiliary aligning means through said passage to an operative position at a level above said second section and an inoperative position beneath said passage.

23. The apparatus of claim 19, further comprising means for stripping the material of stacks off said knife and means for moving said knife upwardly while the knife is engaged by said stripping means so that the material which adheres to the knife is caused to enter said passage.

24. The apparatus of claim 23, wherein stripping means is mounted on said auxiliary aligning means.

25. The apparatus of claim 24, wherein the knife has a surface which is inclined with reference to said plane, said means for moving said stripping means being arranged to move said stripping means against said surface prior to upward movement of said knife.

26. The apparatus of claim 16, wherein said feeding means includes fingers which tend to rest by gravity on the first section of said support.

27. The apparatus of claim 16, wherein said stop includes fingers which tend to rest by qravity on the second section of said support.

28. The apparatus of claim 16, further comprising a severing machine having means for subdividing each of a series of piles of superimposed sheets into a plurality of stacks, and means for transferring selected numbers of stacks of a plurality of stacks onto said first section of said support for engagement by said feeding means.

* * * * *